US006273556B1

(12) United States Patent
Ishinaga et al.

(10) Patent No.: US 6,273,556 B1
(45) Date of Patent: Aug. 14, 2001

(54) LIQUID DISCHARGE HEAD HAVING MOVABLE MEMBER WITH CORROSION-RESISTANT COATING AND METHOD OF MANUFACTURE THEREFOR

(75) Inventors: Hiroyuki Ishinaga, Tokyo; Toshio Kashino, Chigasaki; Shuji Koyama, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/139,400

(22) Filed: Aug. 25, 1998

(30) Foreign Application Priority Data

Aug. 26, 1997 (JP) ..... 9-229655

(51) Int. Cl.[7] ..... B41J 2/05
(52) U.S. Cl. ..... 347/65
(58) Field of Search ..... 347/63, 65, 67

(56) References Cited

U.S. PATENT DOCUMENTS

| | | | |
|---|---|---|---|
| 4,654,676 | 3/1987 | Itano et al. | 347/85 |
| 4,723,129 | 2/1988 | Endo et al. | 347/56 |
| 4,994,825 | 2/1991 | Saito et al. | 347/63 |
| 5,081,474 | 1/1992 | Shibata et al. | 347/59 |
| 5,278,585 | 1/1994 | Karz et al. | 347/65 |
| 5,491,505 | 2/1996 | Suzuki et al. | 347/203 |
| 5,602,576 | 2/1997 | Murooka et al. | 347/59 |

FOREIGN PATENT DOCUMENTS

| | | | |
|---|---|---|---|
| 0 761 439 A2 | 3/1997 | (EP) . | |
| 895801 A1 * | 2/1999 | (EP) | B41J/2/05 |
| 0 895 861 A1 | 2/1999 | (EP) . | |
| 61-59911 | 5/1979 | (JP) . | |
| 61-59914 | 2/1980 | (JP) . | |
| 60-220755 * | 11/1985 | (JP) | B41J/3/04 |
| 8-187867 | 7/1996 | (JP) . | |
| 8-293973 | 11/1996 | (JP) . | |
| 9-070969 | 3/1997 | (JP) . | |
| 9-201966 | 8/1997 | (JP) . | |
| 9-307762 | 11/1997 | (JP) . | |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge head comprises liquid flow paths communicated with liquid discharge port for discharging liquid, bubble generating energy means for creating bubbles in order to discharge the liquid from the liquid discharge port, and movable members facing bubble generating areas for the creation of the bubbles, having free ends on the discharge port side to guide the bubbles to the discharge port side. For this liquid discharge head, the movable members and members capable of presenting electrically conductive relations with the movable members are arranged to satisfy the structural relations of liquid contact surface which do not allow electrolytic corrosion to occur. In this way, almost no deterioration of the members may take place due to electrolytic corrosion caused by liquid to be used and the liquid supply source as well, hence implementing the enhancement of durability of the movable members and the performance of the stabilized discharges of liquid for a long time as well.

25 Claims, 8 Drawing Sheets

LIQUID DISCHARGE HEAD HAVING MOVABLE MEMBER WITH CORROSION-RESISTANT COATING AND METHOD OF MANUFACTURE THEREFOR

BACKGROUND OF THE INVENTION

1. Field of the Invention

The present invention relates to a liquid discharge head that discharges a desired liquid by the creation of bubbles generated by thermal energy acting upon the liquid, and also, to a method of manufacture therefor. More particularly, the invention relates to a liquid discharge head provided with the movable member which is displaceable by the utilization of the creation of bubbles, and to a method of manufacture therefor as well.

In this respect, the term "recording" in the description of the present invention means not only the provision of images having characters, graphics, or other meaningful representation, but also, the provision of those images that do not present any particular meaning, such as patterns.

2. Related Background Art

There has been known the so-called bubble jet recording method, which is an ink jet recording method whereby to form images on a recording medium by discharging ink from discharge port using acting force exerted by the change of states of ink accompanied by the abrupt voluminal changes (creation of bubbles), and to form images on a recording medium by the discharged ink that adheres to it. For the recording apparatus that uses the bubble jet recording method, it is generally practiced to provide, as disclosed in the specifications of Japanese Patent Publication No. 61-59911 and Japanese Patent Publication No. 61-59914, the discharge port that discharge ink, the ink paths communicated with the discharge port, and heat generating member (electrothermal transducing devices) arranged in each of the ink paths, which serve as means for generating energy for discharging ink.

In accordance with such recording method, it is possible to record high quality images at high speeds with a lesser amount of noises. At the same time, the head that executes this recording method makes it possible to arrange the discharge port for discharging ink in high density, with the excellent advantage, among many others, that images are made recordable in high resolution, and that color images are easily obtainable by use of a smaller apparatus. In recent years, therefore, the bubble jet recording method has been widely utilized for a printer, a copying machine, a facsimile equipment, and many other office equipment. Further, this method is utilized for the industrial use, such a textile printing system.

In this respect, some of the inventors hereof have ardently studied the principle of liquid discharge again for the provision of a new liquid discharge method that utilizes the bubbles that have never been obtained by the application of conventional art, as well as the head which is usable for such method, and have applied for a patent as described in the specification of Japanese Patent Application No. 8-4892.

The patent described in the specification of Japanese Patent Application No. 8-4892 is a technique such as to control bubbles positively by arranging the positional relations between the fulcrum and the free end of the movable member in each liquid flow path so that the free end is positioned on the discharge port side, that is, on the downstream side, and that the movable member is positioned to face each heat generating device or bubble generating area.

By use of the liquid discharge head or the like formed in accordance with the extremely new discharge principle as described above, it becomes possible to obtain the synergic effect produced by the created bubbles and the movable member which is caused to be displaced thereby. As a result, liquid in the vicinity of the discharge port is discharged more effectively, and as compared with the conventional discharge method of bubble jet type and heads, the discharge efficiency is enhanced significantly.

With the durability and the responsiveness to the high frequency in view, it is preferable for the discharge method and the apparatus that use the aforesaid movable member to be able to discharge liquid in good condition irrespective of the kinds of liquid, and also, to structure the movable member with the metallic material which gives elasticity at least a part (only on the external surface, only in the interior, or of the entire body).

When the free end of the movable member is structured in a cantilever fashion, the portion on its fulcrum side should be structured so that it is fixed in anyway. For the formation of such a structure of fixation, it is conceivable to use gold bonding or adhesive agent or a mechanical coupling element (such as a screw) to fix the movable member to a pedestal.

However, in a case where the metallic part of the movable member is structured with the metallic material that has been selected from the viewpoint of the elasticity, the durability, or of the easier manufacturing process, and if such selected metal is different from the those metallic materials used for the pedestal or the structure of fixation, a condition may ensue that electrolytic corrosion occurs between them when becoming electrically conductive (due to the direct contact or through the pin holes of resin or the coating layer). If the movable member is left intact under such condition, the property of the movable member may change due to the structural changes thereof (decreased or increased). Consequently, it is conceivable that the discharge characteristics are caused to change accordingly.

The inventors hereof have realized as one of the new objectives that the reliability of the movable member should be maintained stably for a long time under such condition.

Also, it may be expected that with the structure having the movable member arranged in the liquid flow path, which requires the consideration of the properties of the materials used each for the surface to be in contact with liquid and the external layer thereof, respectively, the conductive condition described above may result indirectly depending on the components of the liquid, not necessarily to be in the condition where those portions become electrically conductive directly. In other words, the content of metallic ion or some other ion in the liquid may bring about the condition that causes electrolytic corrosion eventually. Conceivably, an ion of the kind may reside in the liquid flow path due to the structure of a liquid retainer serving as the liquid supply source or due to the use of liquid other than those designated ones. Therefore, it is the second objectives that the reliability of the movable member should be maintained stably for a long time even under such condition as described above.

In consideration of the supporting structure of the movable member, it is also another one of the objectives from the different viewpoint that the structure should be provided in order to enhance the closer contact between the movable member and the pedestal, and also, to the contact between them stronger.

SUMMARY OF THE INVENTION

The present invention is designed with a view to attaining these objectives described above. It is an object of the invention to provide a liquid discharge head with the movable member having excellent durability and elasticity, whereby to implement the enhancement of the durability and the stability of operation of the movable members, and also, to provide a method of manufacture therefor, hence achieving at least one of the aforesaid objectives.

It is another object of the invention to prevent the movable members from being electrolytically corroded by the members other than the movable members residing in the liquid flow paths or by liquid so that the movable members can maintain its excellent durability.

It is still another object of the invention to provide a structure whereby to make the fixation of each of the movable members and its manufacture more reliable, and to provide a method of manufacture therefor as well.

In order to achieve these objects, a liquid discharge head of the present invention comprises:

a liquid flow path communicated with liquid discharge port for discharging liquid;

bubble generating energy means for creating bubbles in order to discharge the liquid from the liquid discharge port; and a movable member facing bubble generating area for the creation of the bubble, having a free end on the discharge port side to guide the bubble to the discharge port side. For this liquid discharge head, the movable member and member capable of presenting an electrically conductive relation with the movable member are to satisfy a structural relation of liquid contact surface not allowing electrolytic corrosion to occur.

Also, a liquid discharge head of the present invention comprises:

a liquid flow path communicated with liquid discharge port for discharging liquid;

bubble generating energy means for creating bubbles in order to discharge the liquid from the liquid discharge port; and a movable member facing a bubble generating area for the creation of the bubble, having a free end on the discharge port side to guide the bubbles to the discharge port side. For this liquid discharge head, at least the liquid contact surface of each of the movable member and a supporting member for supporting the movable member with respect to the liquid is formed by substantially the same material.

Also, a liquid discharge head of the present invention comprises:

a liquid flow path communicated with liquid discharge port for discharging liquid;

bubble generating energy means for creating bubbles in order to discharge the liquid from the liquid discharge port; and a movable member facing bubble generating areas for the creation of the bubbles, having free ends on the discharge port side to guide the bubbles to the discharge port side. For this liquid discharge head, the liquid contact surface of the movable member in contact with the liquid is formed by material having lower oxidation potential than cation contained in liquid to be supplied to the liquid flow path.

Also, the cation contained in the supply liquid is at least one of $Ca^{2+}$, $Fe^{2+}$, $Fe^{3+}$, $Pb^{2+}$, and $Na^{+}$, and the liquid contact surface of movable members has lower oxidation potential than the cation.

Also, the movable member and the member capable of presenting electrically conductive relation with the movable member are to satisfy the structural relation of liquid contact surface which does not allow electrolytic corrosion to occur.

Also, at least the liquid contact surface of each of the movable member and supporting member for supporting the movable member with respect to the liquid is formed by substantially the same material.

Also, a liquid discharge head of the present invention comprises at least:

a discharge port for discharging liquid;

a liquid flow path communicated with the discharge port to supply liquid to the discharge port;

a substrate provided with a heat generating member for creating bubble in liquid;

a movable member arranged in the liquid flow path with a free end on the discharge port side to face the heat generating member; and a pedestal for supporting the movable member on the substrate. For this liquid discharge head, the movable member are covered with coating members having a higher resistance to corrosion than the material forming the movable member.

Also, the pedestal of this liquid discharge head is covered with the coating member.

Also, the coating member is formed by nonconductor.

Also, a contact enhancement layer is arranged to reside inclusively between the interior covered with the coating member and the coating member to enable the interior covered with the coating member and the coating member to be closely in contact.

Also, the contact enhancement layer contains oxygen.

Also, the contact enhancement layer contains a part of element of the coating member.

Also, a liquid discharge head of the present invention comprises at least:

an orifice plate provided with discharge port formed for discharging liquid to determine the direction of liquid discharge;

a liquid flow path communicated with the discharge port in order to supply liquid to the discharge port;

a substrate having heat generating member for creating a bubble in liquid;

a movable member arranged in the liquid flow path, having a free end on the discharge port side to face the heat generating member; and a pedestal portion to support the movable members to the substrate. For this liquid discharge head, the orifice plate, the movable member, and the pedestal portion being formed by the same material.

Also, a method of the present invention for manufacturing a liquid discharge head, each provided with:

a discharge port for discharging liquid;

a liquid flow path communicated with the discharge port in order to supply liquid to the discharge port;

a substrate having a heat generating member for a creating bubble in liquid;

a movable member arranged in the liquid flow path, having a free end on the discharge port side to face the heat generating member; and a pedestal portion to support the movable member to the substrate, comprises the following steps of:

forming the pedestal portions on the substrate in a specific configuration; and forming the movable member in a specific position on the substrate including the portion on the pedestal portion using the same material of the pedestal portion.

Also, the method further comprises the following step of:

covering the movable member with coating member having a higher resistance to corrosion than the material forming the movable member.

Also, the method further comprises the following step of:

covering the pedestal with the coating member.

Also, the coating member is formed by nonconductor.

Also, the method further comprises the following step of:

arranging to reside inclusively a contact enhancement layer between the interior covered with the coating member and the coating member to enable the interior covered with the coating member and the coating member to be closely in contact.

Also, the method of the present invention for manufacturing a liquid discharge head, each provided with:

an orifice plate having a discharge port formed for discharging liquid to determine the direction of liquid discharge;

a liquid flow path communicated with the discharge port in order to supply liquid to the discharge port;

a substrate having heat generating member for creating bubbles in liquid;

a movable member arranged in the liquid flow path, having a free end on the discharge port side to face the heat generating member; and a pedestal portion to support the movable member to the substrate, comprises the following steps of:

forming the pedestal portion on the substrate in a specific configuration;

forming the movable member on the substrate in a specific position including the portion on the pedestal portion using the same material of the pedestal portion; and forming the orifice plate using the same material of the pedestal portion.

Here, each of the terms used for the technical description of the present invention is based on the following contents:

The term "the same material" means the two different materials having substantially the same oxidation potential which is known as the relative ionization tendency between them (the range that satisfies the relations between them in which the materials can hardly be ionized positively each other).

The term "the liquid contact surface" means the surface which is substantially in contact with liquid, including the portion which is exposed to the liquid through pin holes of thin resin.

The term "the materials capable of presenting the electrically conductive relations" means the members being separated but in a state of becoming electrically conductive through electrolytic solution, not to mention the materials which are directly in contact with each other. In this case, those members included in the movable member are the metallic orifice plate, the protection layer that covers each of the electric heat generating member in each of the liquid flow paths or the anti-cavitation layer against the cavitation at the time of defoaming, or the supporting member of the movable member, or at least one of the protection layers above each of the electrodes.

The term "the cation contained in liquid" means not only the cation contained in the initial stage, but also, the cation contained in liquid as impurities, which is supplied anew due to the replacement of ink tanks for use of liquid supply or the resultant cation to be supplied gradually from the structural materials of liquid supply means.

In accordance with the present invention structured as described above, the pedestal portion is formed on the substrate, and after that, the movable member is formed in a specific position including the portion on the pedestal portion using the same material as the one used for the pedestal. In this manner, it becomes possible to prevent each movable member from being deteriorated due to electrolytic corrosion with respect to the liquid to be used and the supply source of the liquid.

Also, when the pedestal and the movable member are covered by coating material having higher resistance to corrosion than the material used for the formation of these members, there is no possibility that the pedestal and movable member are corroded by the liquid to be used or the supply source of the liquid.

Further, since the movable member is incorporated on the substrate directly, there is no need for positioning the movable member to the substrate, making it possible to implement making the interior of many numbers of liquid flow paths finer in a higher precision. Also, when the movable member and the pedestal are formed by the same material, the contactness between them becomes stronger to contribute to the enhancement of the durability of each movable member and more stabilized operation of thereof.

Also, those functions described above are equally applicable to the orifice plate.

BRIEF DESCRIPTION OF THE DRAWINGS

FIG. 3A is a cross-sectional view taken in the direction of the liquid flow path; FIG. 3B is a sectionally perspective view thereof.

FIG. 7A shows the apparatus having the protection layer to be described later; and FIG. 7B shows the apparatus without the provision of any protection layer.

DETAILED DESCRIPTION OF THE PREFERRED EMBODIMENTS

Before describing the specific embodiments of the present invention, the description will be made of the most fundamental structure whereby to enhance the discharge power and the discharge efficiency by controlling the propagating direction of pressure exerted by the creation of bubbles and the developing direction of bubbles when liquid is discharge in accordance with the present invention.

Figure 1A:
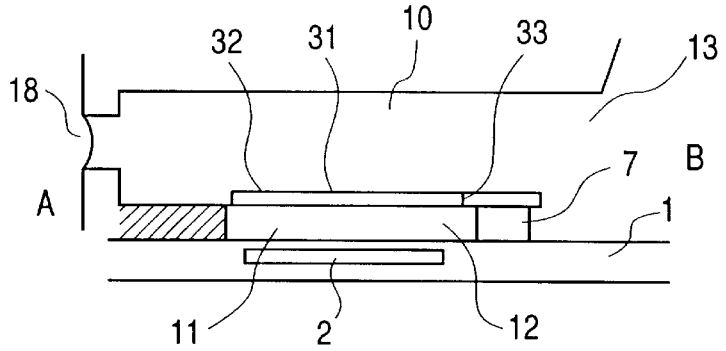
FIGS. 1A, 1B, 1C and 1D are cross-sectional views which illustrate the discharge principle of a liquid discharge head in accordance with the present invention, taken in the direction of the liquid flow path.
Figure 1B:
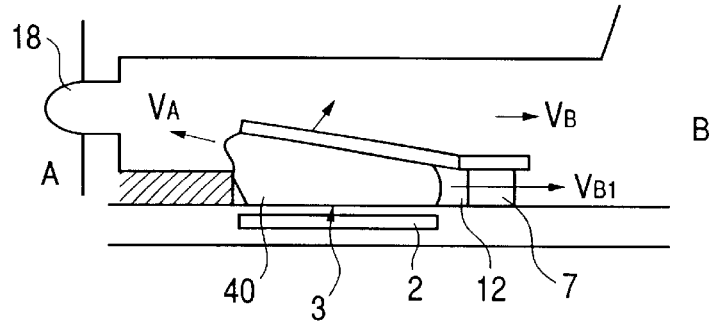
Figure 1C:
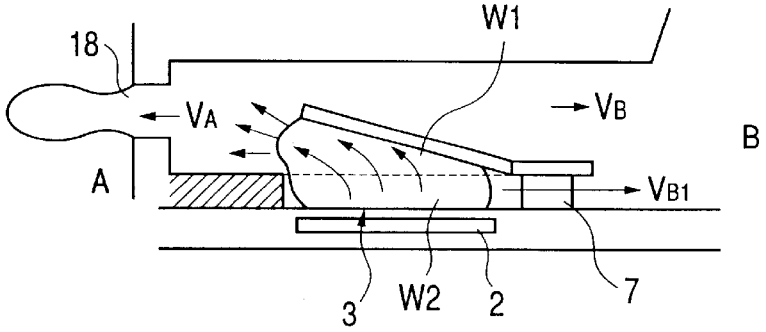
Figure 1D:
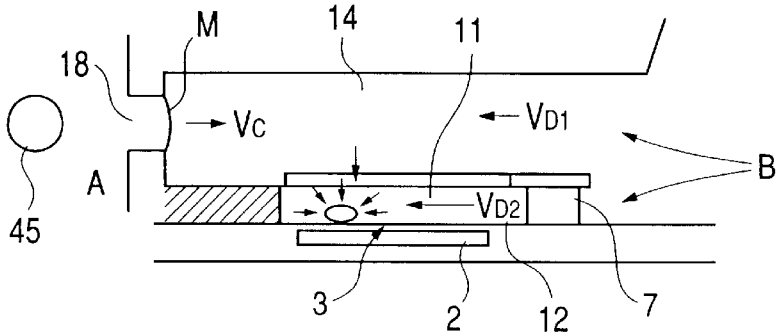
Figure 2:
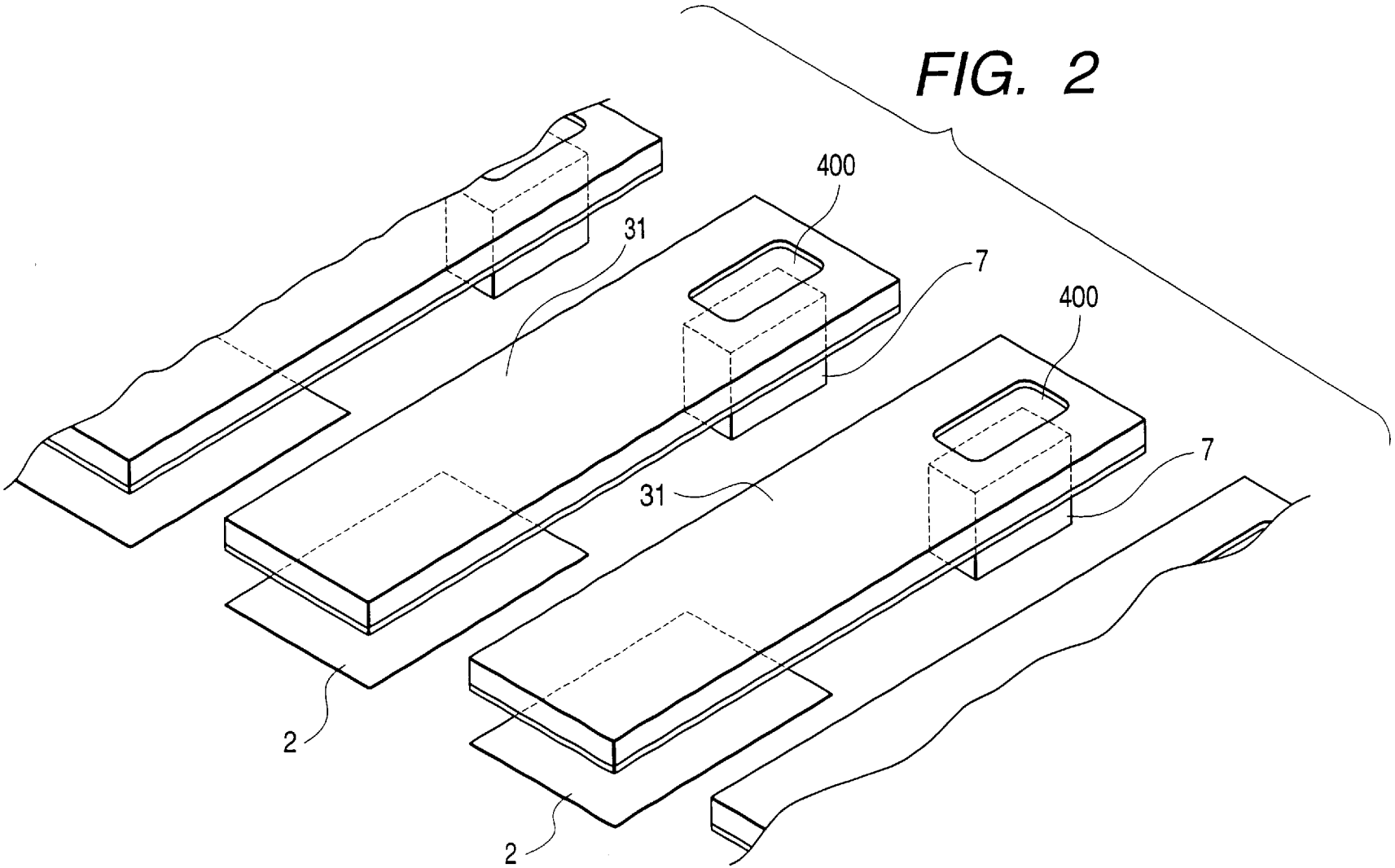
FIG. 2 is a partially broken perspective view which shows the liquid discharge head represented in FIGS. 1A, 1B, 1C and 1D.

FIGS. 1A to 1D are cross-sectional views which illustrate the discharge principle of a liquid discharge head in accordance with the present invention, taken in the direction of the liquid flow path. Also, FIG. 2 is a partially broken perspective view which shows the liquid discharge head represented in FIGS. 1A to 1D.

For the example shown in FIGS. 1A to 1D, a liquid discharge head is provided with a heat generating device 2 (the heat generating resistor having a shape of 40 $\mu$m×105 $\mu$m for this example) that causes thermal energy to act upon liquid, which is arranged on the elemental substrate 1 as the discharge energy generating device to discharge liquid. A liquid flow path 10 is arranged on this elemental substrate corresponding to the heat generating device 2. At the same time that the liquid flow path 10 is communicated with a liquid discharge port 18, a common liquid chamber 13 is communicated with a plurality of liquid flow paths 10. Each of the liquid flow paths 10 receives liquid from this common liquid chamber 13 in an amount corresponding to the liquid that has been discharged from the discharge port 18.

For the liquid flow path 10 on the elemental substrate, a movable member 31 having a plate type plane portion formed by an elastic material, such as metal, is arranged in a cantilever fashion to face the aforesaid heat generating device 2. One end of this movable member is fixed on a pedestal (supporting member) 7 formed by patterning photosensitive resin or the like on the walls of the liquid flow path 10 and the elemental substrate 1. In this manner, the movable member is supported, and at the same time, the fulcrum (supporting portion) 33 is structured.

The movable member 31 has the fulcrum (supporting portion; fixed end) 33 on the upstream side of a large flow running from the common liquid chamber 13 to the discharge port 18 through the movable member 31 by means of the liquid discharge operation. The movable member is arranged with a gap of approximately 15 $\mu$m from the heat generating device 2 in a position to face the heat generating 2 to cover it in order to provide its free end (free end portion) 32 on the downstream side with respect to the fulcrum 33. The gap between the heat generating device 2 and the movable member 31 becomes the bubble generating area 11.

When the heat generating device 2 is energized, heat acts upon liquid on the bubble generating area 11 between the movable member 31 and the heat generating device 2, thus creating bubble in liquid by the film boiling phenomenon disclosed in the specification of U.S. Pat. No. 4,723,129. The pressure exerted by the creation of bubble and the bubble itself act upon the movable member priorly, and as shown in FIGS. 1B and 1C or FIG. 2, the movable member 31 is displaced to open largely to the discharge port 18 side centering on the fulcrum 33. With the displacement of the movable member 31 or with the state of the movable member 31 being displaced, the propagation of pressure exerted by the creation of bubble and the development of the bubble itself is guided to the discharge port 18 side. Also, at this juncture, it becomes easier to guide the bubble generating power of bubble to the discharge port 18 side, because a width is given to the leading end portion of the free end 32. In this way, it is possible to implement the basic enhancement of the discharge efficiency, and the discharge power or the discharge speed.

Now, with reference to the accompanying drawings, the description will be made of the embodiments in accordance with the present invention.

Figure 3A:
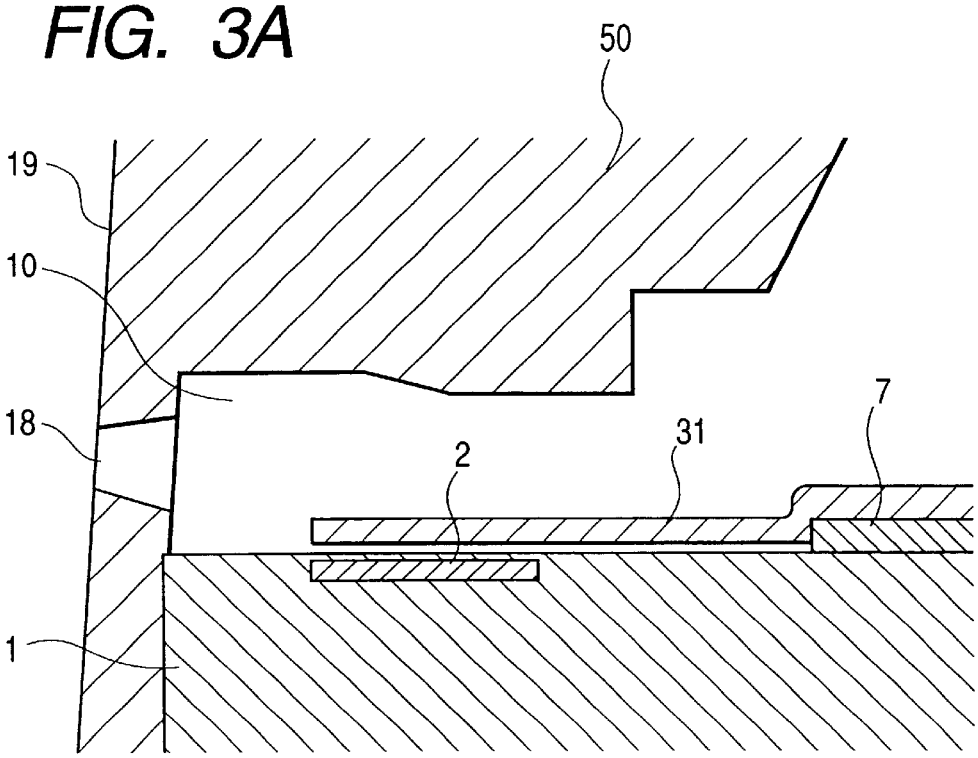
FIGS. 3A and 3B are views which illustrate one embodiment of the liquid discharge head manufactured by a method for manufacturing liquid discharge head in accordance with the present invention.
Figure 3B:
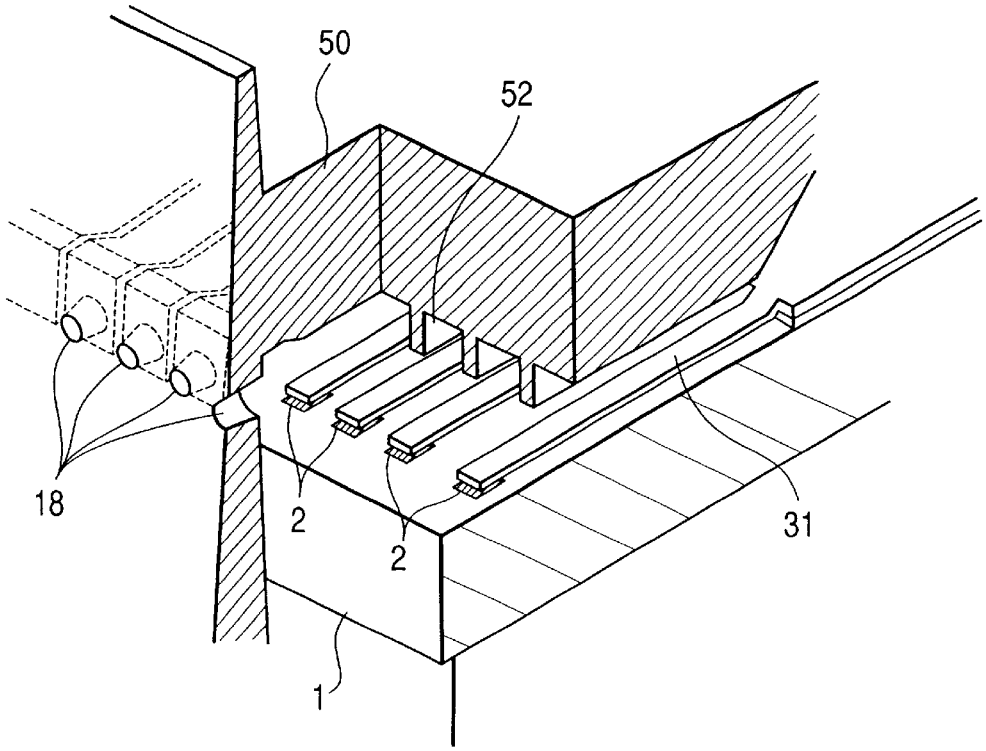

FIGS. 3A and 3B are views which illustrate one embodiment of the liquid discharge head manufactured by a method for manufacturing liquid discharge head in accordance with the present invention; FIG. 3A is a cross-sectional view taken in the direction of the liquid flow path; FIG. 3B is a sectionally perspective view thereof.

As shown in FIGS. 3A and 3B, the present embodiment comprises the heat generating device 2 that creates bubble by the application of heat; the substrate 1 on which each of the heat generating member 2 are incorporated; the discharge port 18 from which liquid is discharged; the orifice plate 19 provided with each of the discharge port 18 to determine the discharge direction of liquid; the liquid flow path 10 to supply the discharging liquid to the discharge port 18; the grooved member 50 that forms each of the liquid flow paths 10; the movable member 31 to be displaced along with the creation of bubble on the heat generating member 2; and pedestal portion 7 that supports the movable member 31. Here, the groove walls 52, which separate a plurality of liquid flow paths 10 from each other, are arranged to extend in the direction toward the orifice plate 19.

Now, hereunder, the description will be made of the method for manufacturing the liquid discharge head structured as described above.

FIGS. 4A to 4H are views which illustrate one embodiment of the method for manufacturing the liquid discharge head represented in FIGS. 3A and 3B.

Figure 4A:
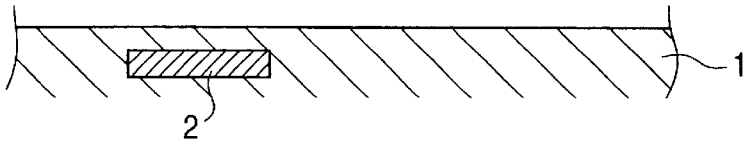
FIGS. 4A, 4B, 4C, 4D, 4E, 4F, 4G and 4H are cross-sectional views which illustrate the method for manufacturing the liquid discharge head shown in FIGS. 3A and 3B in accordance with one embodiment of the present invention.
Figure 4B:
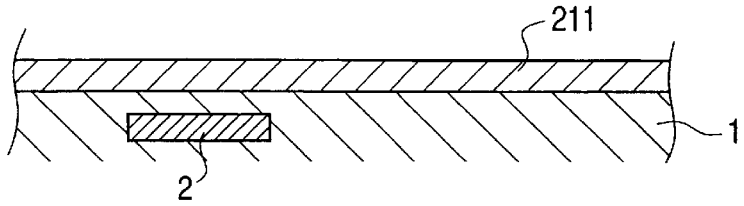

At first, the surface of the substrate 1 having the heat generating member 2 arranged on it (FIG. 4A) is spin coated with resist 211 formed by photosensitive resin (FIG. 4B).

Figure 4C:
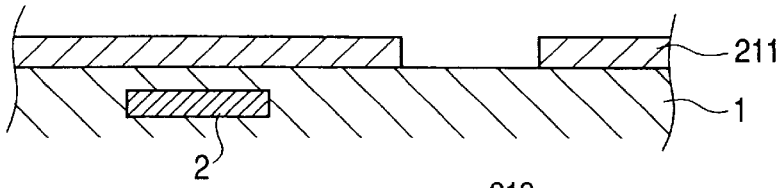

Then, the resist 211 is patterned corresponding to the configuration of the pedestal portion 7 (FIG. 4C).

Figure 4D:
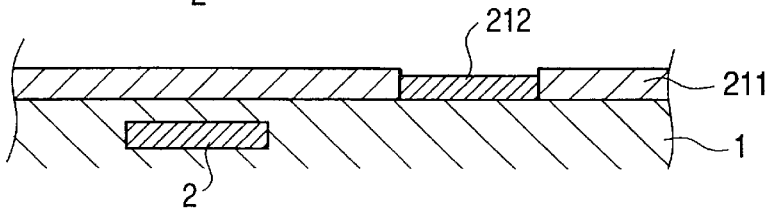

Then, the electroformation is given to the surface of the substrate. Here, on the surface of the substrate, the resist 211 is patterned corresponding to the configuration of the pedestal portion 7. As a result, the metallic layer 212 is formed only on the portion where the resist 211 is removed by patterning (FIG. 4D).

Figure 4E:
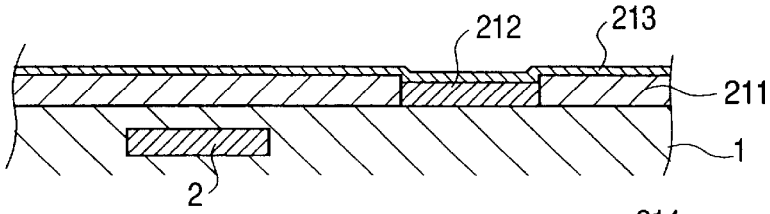

After that, the thin film electrode layer 213 formed by the same metal used for the metallic layer 212 is filmed all over the surface of the substrate 1 by means of sputtering, vapor deposition, or the like (FIG. 4E).

Figure 4F:
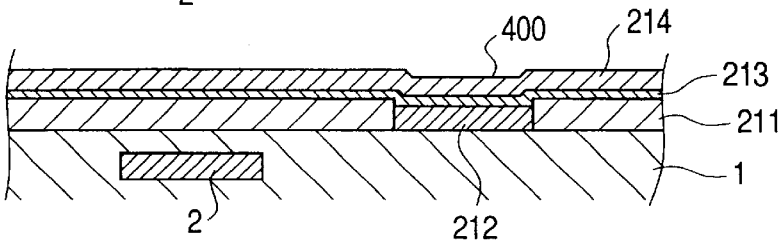

Subsequently, the thin film electrode layer 213 is made electrodes, and the thick film layer 214 is formed by means of electroformation (FIG. 4F).

Figure 4G:
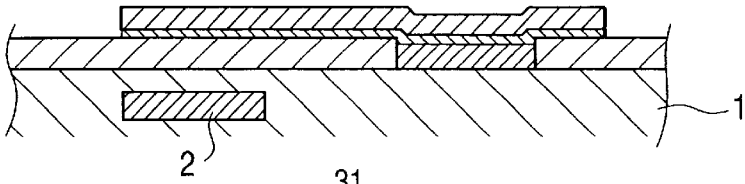

Then, the resist patterning (not shown) and the metallic etching are performed to remove the portion other than the one that becomes the movable member 31 on the thin film electrode layer 213 and the thick film layer 214 (FIG. 4G).

Figure 4H:
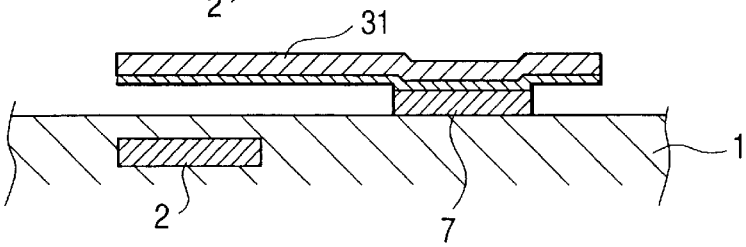

After that, the resist 211 which is coated on the substrate 1 is peeled off (FIG. 4H).

With a series of processes described above, the movable member 31 and the pedestal 7 are integrally formed on the substrate 1 by use of the same material.

Here, in accordance with the present embodiment, the thin film electrode layer 213 and thick film layer 214 are patterned corresponding to the configuration of the movable member 31 (FIG. 4G) after the formation of the thick film layer 214. However, it may be possible to pattern the thin film electrode layer 213 after the formation of the thin film electrode layer 213 (FIG. 4E).

In this respect, as the material of the movable member 31 adopted for the aforesaid liquid discharge head, the nickel or other metals which are superior in elasticity is generally used, because the pressure exerted by the creation of bubble should be utilized efficiently for the discharge of liquid.

However, if a metal, which is superior in its mechanical property, but tends to be ionized, is used as the material of the movable member, such metal is corroded by liquid in the liquid flow path, and with the progress of corrosion, the strength of the movable member itself becomes smaller. As a result, there is a fear that the pressure exerted by the creation of bubble does not function any longer efficiently for the discharge of liquid.

Therefore, if the movable member is covered with a coating material having a higher resistance to corrosion than the material with which to form the movable member, it becomes possible to enhance its resistance to corrosion caused by liquid, while utilizing the pressure exerted by the creation of bubble efficiently for the discharge of liquid.

FIGS. 5A to 5H are cross-sectional views which illustrate the method for manufacturing the liquid discharge head shown in FIGS. 3A and 3B in accordance with another embodiment of the present invention.

In this respect, since the processing steps shown in FIGS. 5A to 5E are the same as those shown in FIGS. 4A and 4E, the description thereof will be omitted.

Figure 5A:
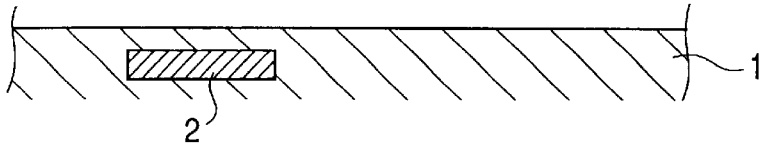
FIGS. 5A, 5B, 5C, 5D, 5E, 5F, 5G and 5H are cross-sectional views which illustrate the method for manufacturing the liquid discharge head shown in FIGS. 3A and 3B in accordance with another embodiment of the present invention.
Figure 5B:
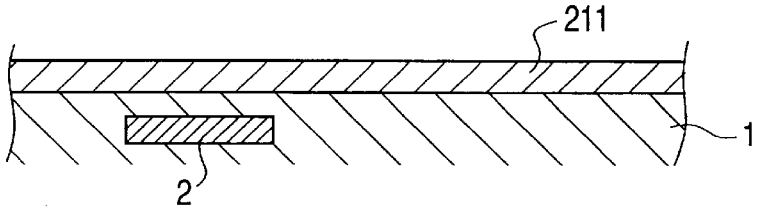
Figure 5C:
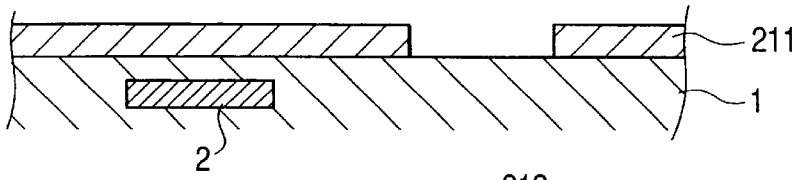
Figure 5D:
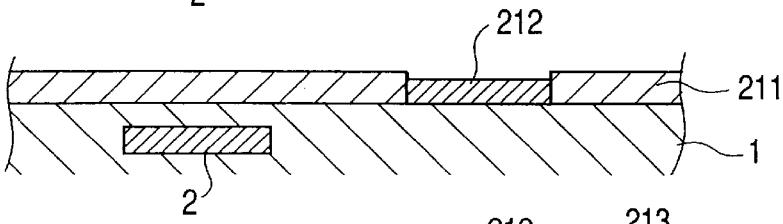
Figure 5E:
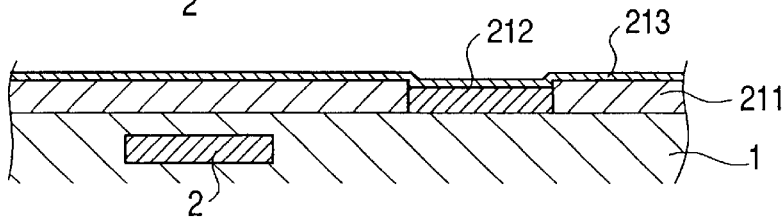
Figure 5F:
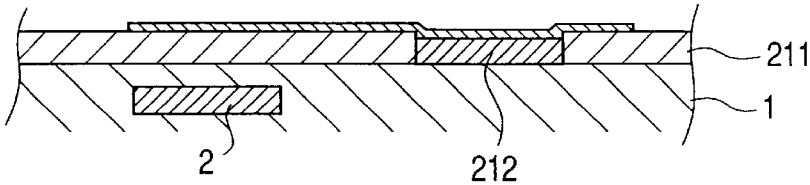

After the thin film electrode layer 213 is formed on the entire upper surface of the substrate 1, the resist coating, patterning, and etching are carried out one after another in that order, hence the etching is made substantially in the same size of the movable member (FIG. 5F).

Figure 5G:
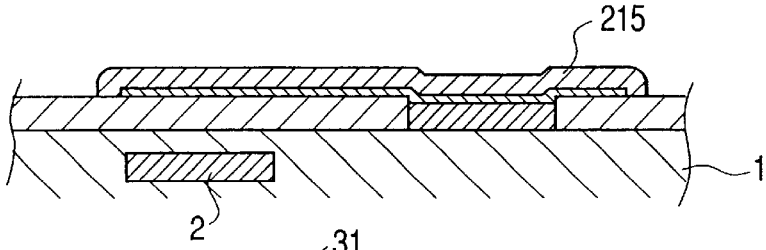

Then, the thin film electrode layer 213 thus etched in the processing step shown in FIG. 5F is used as electrodes to form the movable member layer 215 in the plating process (FIG. 5G).

Figure 5H:
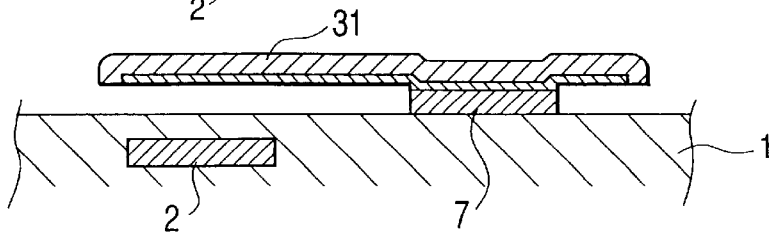

After that, the resist 211 is removed. In this manner, the movable member 31 and the pedestal 7 are formed (FIG. 5H).

Here, the structural materials described above, that is, those used for the movable member 31, the thin film electrode layer 213, and the pedestal portion 7, which present the conductive state eventually, are substantially the same. In this way, it is attempted to effectuate the chemical balance with respect to the liquid to be used, hence making it difficult to cause electrolytic corrosion eventually.

Further, it is preferable to make the substrate substantially with the same materials as those described above if the substrate is in contact with them in the sate of being conductive.

Now, hereunder, the description will be made of the coating process described above.

Figure 6A:
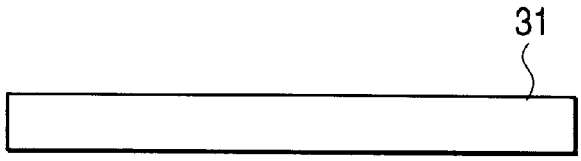
FIGS. 6A, 6B and 6C are views which illustrate the coating process of the movable member incorporated on the substrate in accordance with the processing steps represented in FIGS. 4A, 4B, 4C, 4D, 4E, 4F, 4G and 4H.
Figure 6B:
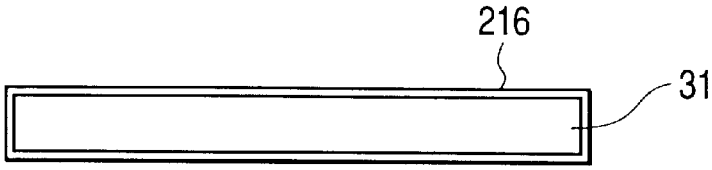
Figure 6C:
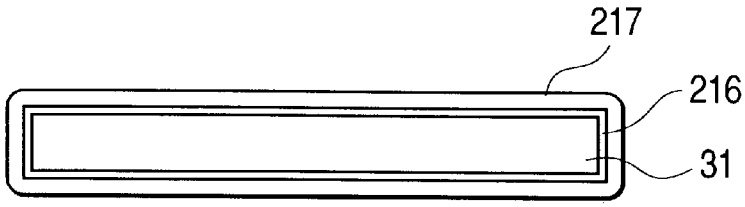

FIGS. 6A to 6C are views which illustrate the coating process of the movable member incorporated on the substrate in accordance with the processing steps represented in FIGS. 4A to 4H.

At first, on the surface of the movable member 31 incorporated on the substrate in accordance with the processing steps shown in FIGS. 4A to 4H (FIG. 6A), the contact enhancement layer 216 is formed (FIG. 6B) by means of oxidization, electroformation, vapor deposition, or the like.

After that, on the surface of the contact enhancement layer 216, the protection layer 217 is formed by means of electroformation or vapor deposition (FIG. 6C).

Here, as described above, the protection layer 217 is formed by the material which has a higher resistance to corrosion than the one used for the movable member. More specifically, if nickel is used for the movable member, tantalum, gold, chromium, or the like is used for the protection layer.

Also, the contact enhancement layer 216 is provided in order to prevent the movable member 31 and the protection layer 217 from being peeled off by the movement of the movable member 31 when these two are formed by metals different from each other. Therefore, the material used for the contact enhancement layer should contain part of elements of the material used for them or it should contain oxygen.

In this respect, the following table shows the examples of the combination of the movable member 31, contact enhancement layer 216, and protection layer 217:

| | Example 1 | Example 2 | Example 3 |
|---|---|---|---|
| Movable member | Ni | Ni | Ni |
| Contact enhancement layer 216 | Ni—Au alloy | $Ta_2O_5$ | Ni—Cr |
| Protection layer 217 | Au | Ta | Cr |

Here, for the protection layer 217, it is not necessarily required to use metal if the contact enhancement layer 216 is formed by the material that does not allow it to be peeled off from the movable member 31. Nonconductor may be used if only it has a higher resistance to corrosion caused by liquid.

Also, in the case of the aforesaid structure, the protection layer that protects the movable member and the pedestal or other parts should only be formed by the same material substantially, it is possible to prevent the movable member and pedestal or other parts from forming the cell structure. Any problem of the kind is not encountered if only any one of them is formed by nonconductive material, of course.

Further, conceivably, not only the movable member 31, but also, the pedestal portion may be integrally coated with the contact enhancement layer 216 and the protection layer 217.

(Other Embodiments)

For the aforesaid embodiment, the integral formation of the movable member 31 and the pedestal portion 7, and the coating thereof have been described. However, if the orifice plate is formed by metal, the orifice plate may be formed integrally with the same material used for the formation of the movable member 31 and the pedestal portion 7. Further, it is conceivable to coat the orifice plate with the contact enhancement layer and the protection layer, together with the movable member 31 and the pedestal portion 7.

Now, hereunder, the description will be made of the structure of the elemental substrate 1 having heat generating member 2 arranged thereon to give heat to liquid.

Figure 7A:
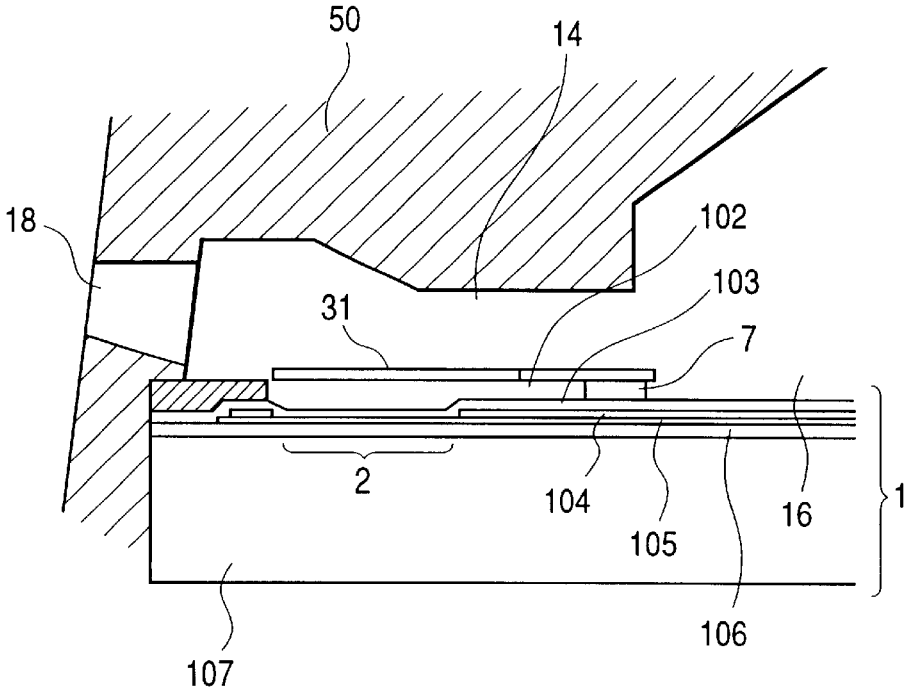
FIGS. 7A and 7B are vertically sectional views which illustrate one structural example of the discharge apparatus to which the liquid discharge head of the present invention is applicable.
Figure 7B:
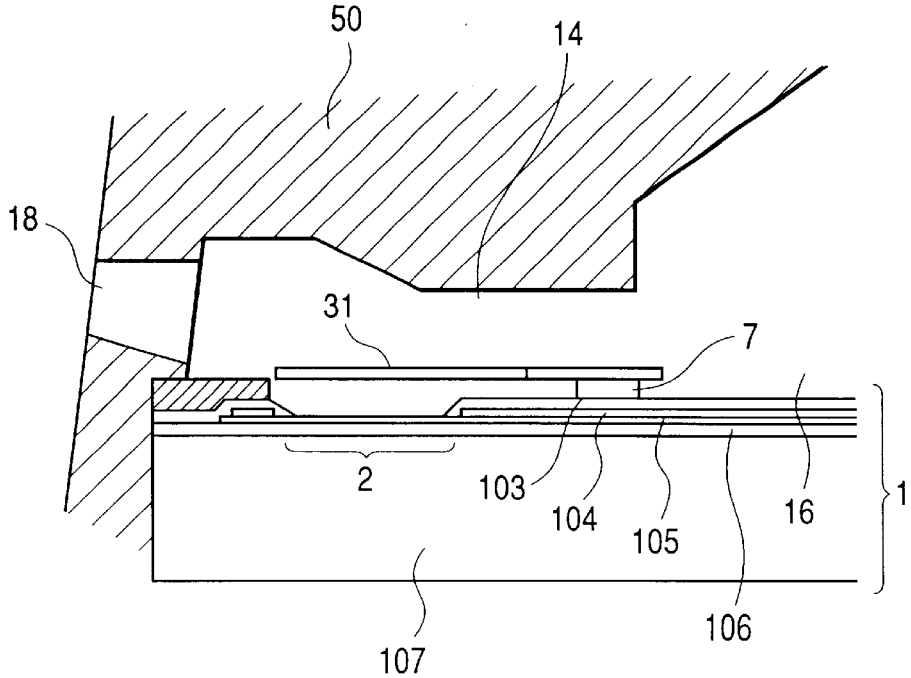

FIGS. 7A and 7B are vertically sectional views which illustrate one structural example of the discharge apparatus to which the liquid discharge head of the present invention is applicable; FIG. 7A shows the apparatus having the protection layer to be described later; and FIG. 7B shows the apparatus without the provision of any protection layer.

In FIGS. 7A and 7B, the liquid flow path 10 shown in FIGS. 1A to 1D is designated as the first liquid flow path 14. Also, the liquid supply path 12 is designated as the second liquid flow path 16. It may be possible to use the same liquid for each of them, but if different liquids are used, the range of selection of liquid to be supplied to the first liquid flow path 14, namely, discharge liquid, is made wider.

As shown in FIGS. 7A and 7B, there are arranged on the elemental substrate 1, the second liquid flow path 16, the movable member 31, and the first liquid flow path 14, and the grooved member 50 provided with the groove that forms the first liquid flow path 14.

On the elemental substrate 1, a silicon oxide film or a silicon nitride film 106 is formed on the substrate 107 of silicon or the like for the purpose of insulation and heat accumulation. On such film, there are patterned, an electric resistance layer 105 of hafnium boride ($HfB_2$), tantalum nitride (TaN), tantalum aluminum (TaAl) or the like, which forms a heat generating device in a thickness of 0.01 to 0.2 $\mu$m, and wiring electrodes 104 of aluminum or the like in a thickness of 0.2 to 1.0 $\mu$m. Then, a voltage is applied to the electric resistance layer 105 from the two wiring electrodes 104 to cause electric current to run for generating heat. On the electric resistance layer 105 across the wiring electrodes 104, a protection layer 103 of silicon oxide, silicon nitride, or the like is formed in a thickness of 0.1 to 0.2 $\mu$m. Further on it, an anti-cavitation layer 102 of tantalum or the like is formed in a thickness of 0.1 to 0.6 $\mu$m, hence protecting the electric resistance layer 105 from ink or various other kinds of liquids.

The pressure and shock waves are very strong, particularly when each of the bubbles is generated or disappears. Then, the durability of the oxide film, which is hard but brittle, tends to be lowered extremely. Therefore, tantalum (Ta) or other metallic material is used as the anti-cavitation layer 102.

Also, there may be adoptable a structure that does not use any protection layer as described above, but just by arranging an appropriate combination of the liquid, the liquid flow structure, and the resistive material. Now, such example is shown in FIG. 7B.

As the material used for the resistance layer that does not require any protection layer, an alloy of iridium-tantalum-aluminum is adoptable. Particularly, now that the present invention makes it possible to separate the liquid for bubbling use from the discharge liquid, it presents its particular advantage when no protection layer is adopted in such a case as this.

As described above, the structure of the heat generating device 2 adopted for the present embodiment may be provided only with the electric resistance layer 105 (heat generating portion) across the wiring electrodes 104 or may be arranged to include a protection layer to protect the electric resistance layer.

In accordance with the present embodiment, the heat generating device 2, which is adopted therefor, is provided with the heat generating portion formed by the resistance layer that generates heat in response to electric signals. The present invention is not necessarily limited to such element. It should be good enough if only the element can create each bubble in the bubbling liquid, which is capable enough to discharge the liquid for discharging use. For example, there may be a heat generating device provided with the photothermal transducing unit as the heat generating portion that generates heat when receiving laser or other light beams or provided with a heat generating portion that generates heat when receiving high frequency.

In this respect, on the elemental substrate 1 described earlier, there may be incorporated functional devices integrally by the semiconductor manufacturing processes, such as transistors, diodes, latches, shift registers, which are needed for selectively driving the electrothermal transducing devices, besides each of the electrothermal transducing devices, which is structured by the electric resistance layer 105 that forms the heat generating portion, and wiring electrodes 104 that supply electric signals to the electric resistance layer 105.

Also, it may be possible to drive the heat generating portion of each electrothermal transducing device arranged on the elemental substrate 1 described above so as to apply rectangular pulses to the electric resistance layer 105 through the wiring electrodes 104 to cause the layer between the electrodes to generate heat abruptly for discharging liquid.

Figure 8:
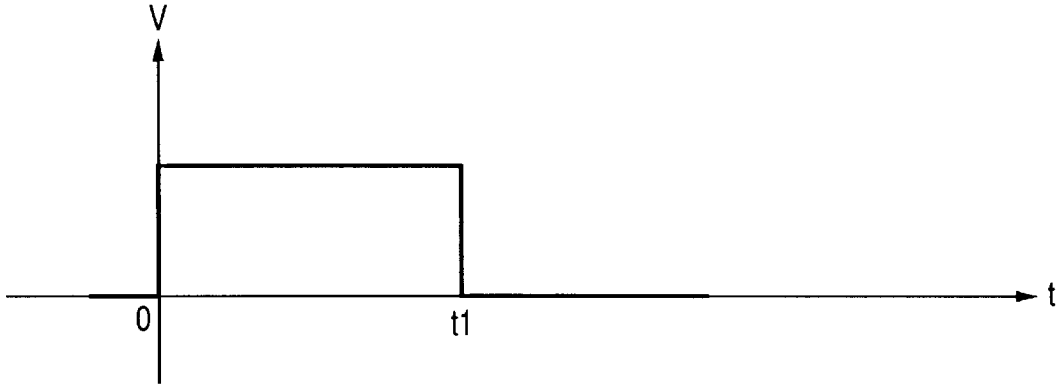
FIG. 8 is a view which shows the waveform of the voltage applied to the electric resistance layer represented in FIGS. 7A and 7B.

FIG. 8 is a view which shows the voltage waveform to be applied to the electric resistance layer 105 represented in FIGS. 7A and 7B.

For the discharge apparatus of the embodiment described above, the electric signal of 6 kHz is applied at a voltage 24 V with the pulse width of 7 $\mu$sec, and at the electric current of 150 mA to drive each heat generating device. With the operation described earlier, ink serving as liquid is discharged from each of the discharge port. However, the present invention is not necessarily limited to these conditions of driving signal. It may be possible to apply the driving signals under any condition if only such signals can act upon the bubbling liquid to bubble appropriately.

Now, hereunder, the description will be made of the structural example of a discharge apparatus provided with two common liquid chambers, while curtailing the number of parts. Here, different kinds of liquids are retained in each of the common liquid chambers by separating them in good condition (to supply discharge liquid to the first liquid flow path, and the bubbling liquid to the second liquid flow path), which makes the remarkable cost reduction possible.

Here, however, depending on the kind of liquid, the discharge liquid and the bubbling liquid may be the same.

Figure 9:
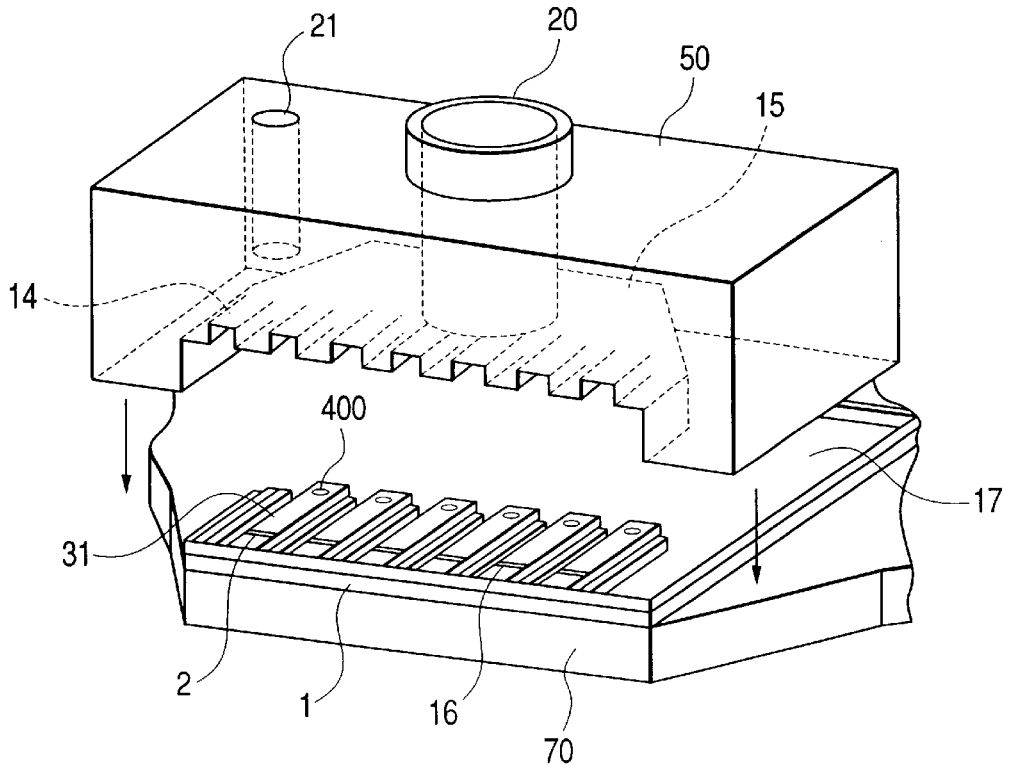
FIG. 9 is an exploded perspective view which shows one structural example of the liquid discharge apparatus to which the liquid discharge head of the present invention is applicable.

FIG. 9 is an exploded perspective view which shows one structural example of the discharge apparatus to which the liquid discharge head of the present invention is applicable.

For the present embodiment, there is arranged on the supporting member 70 formed by metal, such as aluminum, the elemental substrate 1 having a plurality of electrothermal transducing devices on it serving as heat generating member 2 that generate heat for the creation of bubble by means of film boiling in bubbling liquid as described earlier.

On the elemental substrate 1, there are arranged a plurality of grooves that constitute each of the second liquid flow path 16 formed by DF dry film; a recessed portion that constitutes the second common liquid chamber (common bubbling liquid chamber) 17 which is communicated with each of the second liquid flow paths 16 in order to supply bubbling liquid to each of them; and the separation walls 30 to which each of the movable members 31 is bonded as described earlier.

The grooved member 50 is provided with the grooves which constitute the first liquid flow paths (discharge liquid flow paths) 14 by being bonded to the separation walls 30; the recessed portion communicated with the discharge liquid flow paths, which constitutes the first common liquid chamber (common discharge chamber) 15 to supply discharge liquid to each of the first liquid flow paths 14; the first liquid supply path (discharge liquid supply path) 20 to supply discharge liquid to the first common liquid chamber 15; and the second liquid supply path (bubbling liquid supply path) 21 to supply bubbling liquid to the second common liquid chamber 17. The second liquid supply path 21 is connected with the conductive path that is communicated with the second common liquid chamber 17 by penetrating the movable members 31 and the separation walls 30 arranged outside the first common liquid chamber 15. Through this conductive path, the bubbling liquid is supplied to the second common liquid chamber 17 without being mixed with the discharge liquid.

In this respect, the arrangement relations between the movable members 31, separation walls 30, and the grooved member 50 is such that each movable member 31 is arranged corresponding to each of the heat generating member on the elemental substrate 1, and that each of the first liquid flow paths 14 is arranged corresponding to each of the movable members 31. Also, in accordance with the present embodiment, the example is shown, in which the second supply path 21 is arranged for one grooved member 50. However, it may be possible to arrange this supply path in plural numbers depending on the amount of liquid supply. Further, the sectional areas of the first liquid supply path 20 and the second liquid supply path 21 can be determined in proportion to the amount of supplies. To optimize the sectional areas of the flow paths, it becomes possible to make the parts that form the grooved member 50 and others smaller still.

In accordance with the present invention as described above, the pedestal portion is formed on the substrate, and then, the movable member is formed on a specific position including the portion on the pedestal portion using the same material as the one used for the pedestal. In this way, almost no deterioration of the members may take place due to electrolytic corrosion with respect to liquid to be used and the liquid supply source as well.

Also, when the pedestal portion and the movable member are covered by the coating members having a higher resistance to corrosion than the material used for them, there is no possibility that the pedestal and the movable member are corroded by the liquid to be used and the liquid supply source, hence implementing the enhancement of the durability of the pedestal and the movable member.

Further, since the movable member is directly incorporated on the substrate, there is no need for positioning the movable member to the substrate. As a result, it becomes possible to implement making the interior of many numbers of liquid flow path finer in a higher precision. Also, when the movable member and the pedestal portion are formed by the same material, the close contactness becomes stronger, thus implementing the enhancement of the durability of the movable member and making the operation of the movable member more stable.

Also, the aforesaid effects can be demonstrated equally on the orifice plate.

What is claimed is:

1. A liquid discharge head comprising:

a discharge port for discharging liquid;

a liquid flow path communicating with said discharge port to supply said liquid to said discharge port;

a substrate provided with a heat generating member for creating a bubble in said liquid;

a movable member arranged in said liquid flow path with a free end on said discharge port side to face said heat generating member; and a pedestal for supporting said movable member on said substrate, wherein said movable member is covered with a coating member having a higher resistance to corrosion than a material forming said movable member.

2. A liquid discharge head according to claim 1, wherein said pedestal is covered with said coating member.

3. A liquid discharge head according to claim 2, wherein said coating member is nonconductive.

4. A liquid discharge head according to claim 3, wherein an interior portion is covered by said coating member and a contact enhancement layer is arranged between said interior portion and said coating member to enable said interior portion and said coating member to maintain close contact.

5. A liquid discharge head according to claim 4, wherein said contact enhancement layer contains oxygen.

6. A liquid discharge head according to claim 4, wherein said contact enhancement layer contains at least one element in common with said coating member.

7. A liquid discharge head according to claim 2, wherein an interior portion is covered by said coating member and a contact enhancement layer is arranged between said interior portion and said coating member to enable said interior portion and said coating member to maintain close contact.

8. A liquid discharge head according to claim 7, wherein said contact enhancement layer contains oxygen.

9. A liquid discharge head according to claim 7, wherein said contact enhancement layer contains at least one element in common with said coating member.

10. A liquid discharge head according to claim 1, wherein said coating member is nonconductive.

11. A liquid discharge head according to claim 10, wherein an interior portion is covered by said coating member and a contact enhancement layer is arranged between said interior portion and said coating member to enable said interior portion and said coating member to maintain close contact.

12. A liquid discharge head according to claim 11, wherein said contact enhancement layer contains oxygen.

13. A liquid discharge head according to claim 11, wherein said contact enhancement layer contains at least one element in common with said coating member.

14. A liquid discharge head according to claim 1, wherein an interior portion is covered by said coating member and a contact enhancement layer is arranged between said interior portion and said coating member to enable said interior portion and said coating member to maintain close contact.

15. A liquid discharge head according to claim 14, wherein said contact enhancement layer contains oxygen.

16. A liquid discharge head according to claim 14, wherein said contact enhancement layer contains at least one element in common with said coating member.

17. A method for manufacturing a liquid discharge head provided with a discharge port for discharging liquid; a liquid flow path communicating with said discharge port in order to supply said liquid to said discharge port; a substrate having a heat generating member for creating a bubble in said liquid; a movable member arranged in said liquid flow path, having a free end on said discharge port side to face said heat generating member; and a pedestal portion to support said movable member to said substrate, said method comprising the steps of:

forming said pedestal portion on said substrate in a specific configuration;

forming said movable member in a predetermined position on said substrate, including a portion formed on said pedestal portion, using a same material as said pedestal portion; and covering said movable member with a coating member having a higher resistance to corrosion than the material forming said movable member.

18. A method for manufacturing liquid discharge heads according to claim 17, further comprising the step of covering said pedestal with said coating member.

19. A method for manufacturing liquid discharge heads according to claim 18, wherein said coating member is nonconductive.

20. A method for manufacturing liquid discharge heads according to claim 19, wherein an interior portion is covered by said coating member, said method further comprising the step of arranging a contact enhancement layer between said interior portion and said coating member to enable said interior portion and said coating member to maintain close contact.

21. A method for manufacturing liquid discharge heads according to claim 18, wherein an interior portion is covered by said coating member, said method further comprising the step of arranging a contact enhancement layer between said interior portion and said coating member to enable said interior portion and said coating member to maintain close contact.

22. A method for manufacturing liquid discharge heads according to claim 17, wherein said coating member is nonconductive.

23. A method for manufacturing liquid discharge heads according to claim 22, wherein an interior portion is covered by said coating member, said method further comprising the step of arranging a contact enhancement layer between said interior portion and said coating member to enable said interior portion and said coating member to maintain close contact.

24. A method for manufacturing liquid discharge heads according to claim 17, wherein an interior portion is covered by said coating member, said method further comprising the step of arranging a contact enhancement layer between said interior portion and said coating member to enable said interior portion and said coating member to maintain close contact.

25. A method for manufacturing a liquid discharge head provided with a discharge port for discharging liquid; a liquid flow path communicating with said discharge port in order to supply said liquid to said discharge port; a substrate having a heat generating member for creating a bubble in said liquid; a movable member arranged in said liquid flow path, having a free end on said discharge port side to face said heat generating member; and a pedestal portion to support said movable member to said substrate, said method comprising the steps of:

forming said pedestal portion on said substrate in a specific configuration; and forming said movable member in a predetermined position on said substrate, including a portion formed on said pedestal portion, using a same material as said pedestal portion;

wherein an interior portion is covered by said coating member and a contact enhancement layer is arranged between said interior portion and said coating member to enable said interior portion and said coating member to maintain close contact.

* * * * *

UNITED STATES PATENT AND TRADEMARK OFFICE

CERTIFICATE OF CORRECTION

PATENT NO. : 6,273,556 B1
DATED : August 14, 2001
INVENTOR(S) : Ishinaga et al.

It is certified that error appears in the above-identified patent and that said Letters Patent is hereby corrected as shown below:

Title page,
Item [56], References Cited, under FOREIGN PATENT DOCUMENTS, 61-59911 5/1979 (JP)" should read -- 61-59911 5/1986 (JP) --; and "61-59914 2/1980 (JP)" should read -- 61-59914 2/1986 (JP) --.

Column 1,
Line 34, "discharge" should read -- discharges --.

Column 2,
Line 55, "objectives" should read -- objective --.

Column 6,
Line 22, "of" should be deleted.

Column 9,
Line 50, "sate" should read -- state --.

Column 16,
Line 21, "portion;" should read -- portion, --.

Signed and Sealed this

Ninth Day of July, 2002

*Attest:*

*Attesting Officer*

JAMES E. ROGAN
*Director of the United States Patent and Trademark Office*